US005797785A

United States Patent [19]

Silberstein

[11] Patent Number: 5,797,785

[45] Date of Patent: Aug. 25, 1998

[54] THREE ARM MOBILE

[75] Inventor: Michael Silberstein, La Jolla, Calif.

[73] Assignee: Infantino, A Dorel Company, Chula Vista, Calif.

[21] Appl. No.: 661,182

[22] Filed: Jun. 10, 1996

[51] Int. Cl.[6] ..... A63H 33/00

[52] U.S. Cl. ..... 446/227; 40/411

[58] Field of Search ..... 446/227, 228, 446/236, 242, 246; 40/455, 411, 414

[56] References Cited

U.S. PATENT DOCUMENTS

| | | | |
|---|---|---|---|
| 2,994,156 | 8/1961 | Steiner et al. | 446/227 |
| 3,290,817 | 12/1966 | Kravath | 446/227 |
| 3,699,704 | 10/1972 | Hakim | 446/227 |
| 4,904,220 | 2/1990 | Williams et al. | 446/227 |

OTHER PUBLICATIONS

Kenner Products Co., "Musical Nursery Birds", Playthings, Aug. 1961.

*Primary Examiner*—Robert A. Hafer
*Assistant Examiner*—D. Neal Muir
*Attorney, Agent, or Firm*—Stetina Brunda Garred & Brucker

[57] ABSTRACT

A decorative mobile comprising a central housing having a musical drive unit disposed therein. Integrally connected to and extending outwardly from the housing in intervals of approximately 120 degrees are three arcuately contoured elongate arms. Two of the arms are of a first substantially equal length, with the remaining arm being of a second length which is less than the first length.

11 Claims, 3 Drawing Sheets

THREE ARM MOBILE

FIELD OF THE INVENTION

The present invention relates generally to infant products, and more particularly to a three arm mobile for attachment to a crib.

BACKGROUND OF THE INVENTION

An extremely popular and traditional infant accessory which is a staple part of many nurseries is a musical, ornamental mobile. As is well known, the mobile is typically attached to the crib and suspended thereover for the enjoyment and entertainment of the lying infant. Mobiles constructed in accordance with the prior art generally comprise an elongate, arcuately contoured support base, one end of which is rigidly secured to a side rail of the crib. The opposite, distal end of the support base extends to approximately the longitudinal axis of the crib mattress and is suspended thereover. The distal end of the support base typically includes a recess or other detent formed therein.

In the prior art mobiles, attached to the distal end of the support base is a circularly configured, rotatable music box component which includes an output shaft extending radially from the peripheral edge thereof. Rotatably attached to the distal end of the output shaft is a hook member which is adapted to be received into the recess formed in the distal end of the support base. Also extending radially from the peripheral edge of the music box component in opposed relation to the output shaft is a stationary eyelet member.

In addition to the support base and the music box component, the prior art mobiles include a hanger assembly comprising a pair of cross-members which extend in perpendicular relation to each other, thus defining four (4) arms of substantially equal length which are separated by intervals of approximately ninety degrees. Attached to the cross-members in the center thereof (i.e., the point at which the cross-members intersect) is a hook member which is adapted be extensible through the eyelet member extending from the music box component. The hanger assembly further includes four (4) ornaments which are attached to the distal ends of respective ones of the four (4) arms defined by the cross-members. In some prior art hanger assemblies, the cross-members further include a cloth canopy applied thereto.

In the prior art mobiles, the music box component further includes a handle which, when rotated, winds the music box component so as to cause the same to play a musical tune and rotate relative to the hook member attached to the output shaft. The hook member is itself maintained stationary by its engagement to the distal end of the support base. The rotation of the music box component facilitates the concurrent rotation of the hanger assembly suspended therefrom.

Though prior art mobiles perform the intended function of entertaining the infant within the crib, they posseses certain deficiencies which detract from their overall utility. In this respect, such prior art mobiles include three (3) separate and distinct components, i.e., the support base, the music box component, and the hanger assembly. The inclusion of these three different components results in the manufacturing costs associated with prior art mobiles being relatively high. Additionally, the inclusion of the separate music box component intermediate the support base and the hanger assembly causes the hanger assembly, and more particularly the ornaments thereon, to be suspended at a relatively low height relative to the crib mattress. Such low suspension makes the ornaments more susceptible to being grasped and pulled by the lying infant, thereby increasing the risk of the inadvertent disconnection of the hanger assembly from the music box component and/or the music box component from the support base. As will be recognized, such inadvertent disconnection is undesirable due to the potential for resultant injury to the lying infant.

The present invention is adapted to overcome the deficiencies associated with the prior art mobiles by providing a three arm mobile wherein each of the three arms is integrally connected to a central housing which accommodates a musical drive unit. As such, in the three arm mobile constructed in accordance with the present invention, the prior art hanger assembly and music box component are combined in a single unit, which significantly reduces the associated manufacturing costs. Further reducing such manufacturing costs is the inclusion of only three arms, rather than the traditional four arms. In addition to providing economies of manufacture, the combination of the music box component and hanger assembly as a single unit in accordance with the present invention allows the same to be maintained at a higher elevation relative to the crib mattress, thus making the ornaments included therewith less susceptible to inadvertent grasping by the lying infant.

SUMMARY OF THE INVENTION

In accordance with the present invention, there is provided a decorative mobile which comprises a central housing. The housing itself comprises upper and lower sections which are attached to each other, and includes opposed pairs of longitudinal and lateral sides separated by four (4) rounded corner regions which define the transition between the longitudinal and lateral sides. Disposed within the interior of the housing is a wind-up musical drive unit including an output shaft extending therefrom which protrudes from the upper section of the housing. The drive unit is selectively wound by a handle member which is mechanically coupled thereto and rotatably connected to one of the longitudinal sides of the housing. Rotatably connected to the distal end of the output shaft is a suspension hook. When operatively wound, the drive unit is adapted to play musical notes and to rotate the output shaft.

The mobile constructed in accordance with the present invention further comprises three (3) elongate arms, the proximal ends of which are integrally connected to and form part of the upper section of the housing. Each of the three elongate arms is arcuately contoured, with two (2) of the arms being of a first substantially equal length, and the remaining arm being of a second length which is less than the first length. In the preferred embodiment, one of the arms of the first length extends outwardly from the longitudinal side of the housing opposite that including the handle member rotatably connected thereto. The other arm of the first length and the arm of the second length each extend outwardly from respective ones of the two (2) corner regions defined between the lateral sides of the housing and the longitudinal side including the handle member rotatably connected thereto (i.e., the longitudinal side opposite that including the arm of the first length extending therefrom).

Due to the manner in which the arms are oriented upon the upper section of the housing, the distal ends thereof are separated by intervals of approximately 120 degrees. Additionally, the distal end of each of the arms includes an aperture disposed therein for facilitating the attachment of a decorative ornament thereto. The housing and the integrally connected arms are preferably fabricated from a plastic material, as are the handle member and suspension hook.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
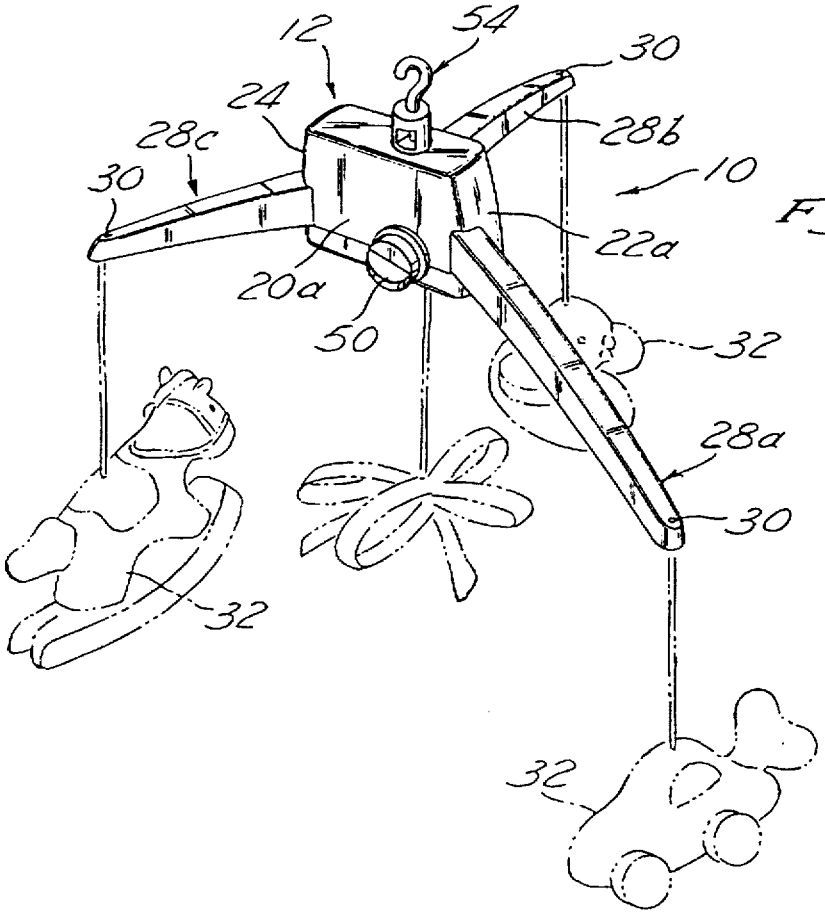
FIG. 1 is a top perspective view of the three arm mobile of the present invention.
Figure 6:
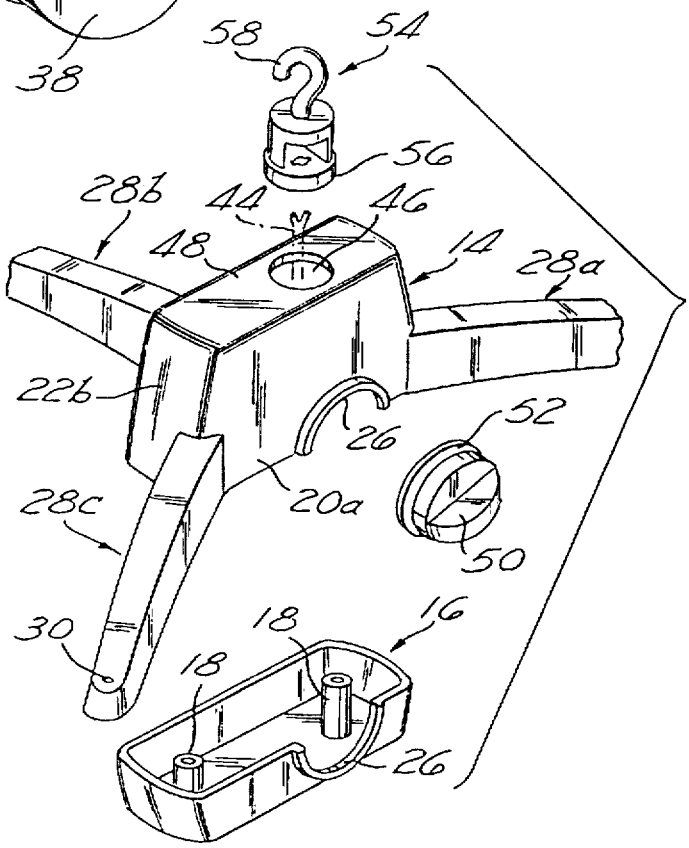
FIG. 6 is a exploded view illustrating the components comprising the three arm mobile excluding the musical drive unit shown in FIG. 5.

Referring now to the drawings wherein the showings are for purposes of illustrating a preferred embodiment of the present invention only, and not for purposes of limiting the same, FIG. 1 perspectively illustrates a three arm mobile 10 constructed in accordance with the present invention. Referring now to FIGS. 1–4 and 6, the mobile 10 comprises a rectangularly configured central housing 12 which, as best seen in FIG. 6, includes an upper housing section 14 and a lower housing section 16. The upper and lower housing sections 14, 16 are rigidly attached to each other via the extension of fasteners (not shown) such as screws through a pair of tubular bosses 18 formed on the lower housing section 16 and into a corresponding pair of internally threaded apertures formed within the upper housing section 14.

Figure 4:
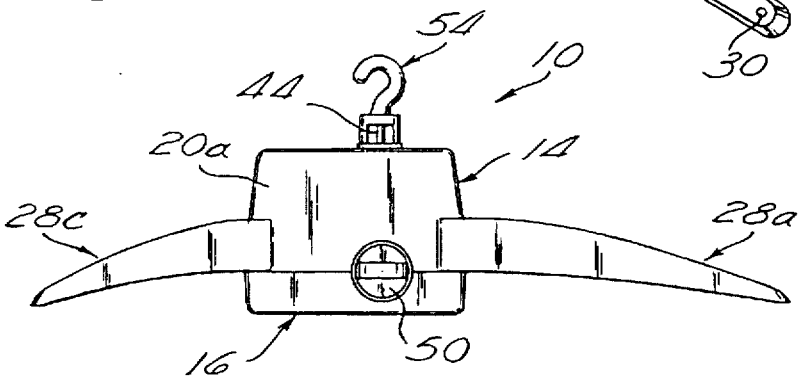
FIG. 4 is a side elevational view of the present invention.

The housing 12 itself defines an opposed pair of longitudinal sides 20*a*, 20*b* and an opposed pair of lateral sides 22*a*, 22*b*. The transition between the longitudinal and lateral sides 20*a*, 20*b*, 22*a*, 22*b* is defined by four (4) rounded corner regions 24 of the housing 12. As best seen in FIGS. 4 and 6, the upper and lower housing sections 14, 16 each include a semi-circular recess 26 formed therein. In this respect, when the upper and lower housing sections 14, 16 are attached to each other, the semi-circular recesses 26 collectively define a circularly configured opening which is disposed within the longitudinal side 20*a* of the housing 12. The opening defined by the recesses 26 is not centered between the corner regions 24 partially defining the longitudinal side 20*a*, but rather is offset toward the lateral side 22*a*. The use of the opening will be discussed in more detail below. As will be recognized, the longitudinal and lateral sides 20*a*, 20*b*, 22*a*, 22*b* of the housing 12 are defined by portions of the upper and lower housing sections 14, 16.

Attached to and extending outwardly from the housing 12, and more particularly the upper housing section 14, are three (3) elongate arms 28*a*, 28*b*, 28*c*. In the preferred embodiment, the arms 28*a*, 28*b*, 28*c* are each arcuately contoured, with the proximal ends thereof being attached to the upper housing section 14 such that the distal ends are separated by intervals of approximately 120 degrees. As best seen in FIGS. 1–3 and 6, the arms 28*a*, 28*c* are attached to and extend outwardly from the corner regions 24 which define the transition between the longitudinal side 20*a* and lateral sides 22*a*, 22*b*. The arm 28*b* is attached to and extends outwardly (i.e., perpendicularly) from the longitudinal side 20*b*, and is centrally oriented between the corner regions 24 which define the transition between the longitudinal side 20*b* and the lateral sides 22*a*, 22*b*.

Importantly, the arms 28*a*, 28*b*, 28*c* are not all of equal length. Rather, the arms 28*a*, 28*b* are of a first substantially equal length, with arm 28*a* slightly exceeding the length of arm 28*b* by approximately 0.03 inches. In contrast, the arm 28*c* is of a second length which is substantially less than the first length, i.e., the second length is approximately 2.0 inches shorter than the first length. As will be discussed in more detail below, the geometry of the housing 12 and configuration/weight of the component disposed therein necessitates the fabrication of the arm 28*c* with a shorter length than the arms 28*a*, 28*b* to provide the mobile 10 with a proportional appearance and maintain the same in a substantially level orientation when suspended from a support base.

Figure 2:
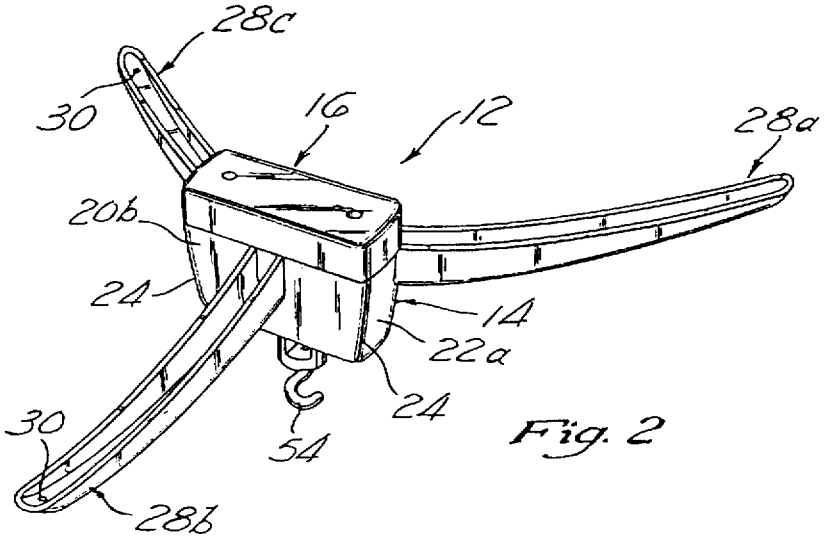
FIG. 2 is a bottom perspective view of the present invention.
Figure 3:
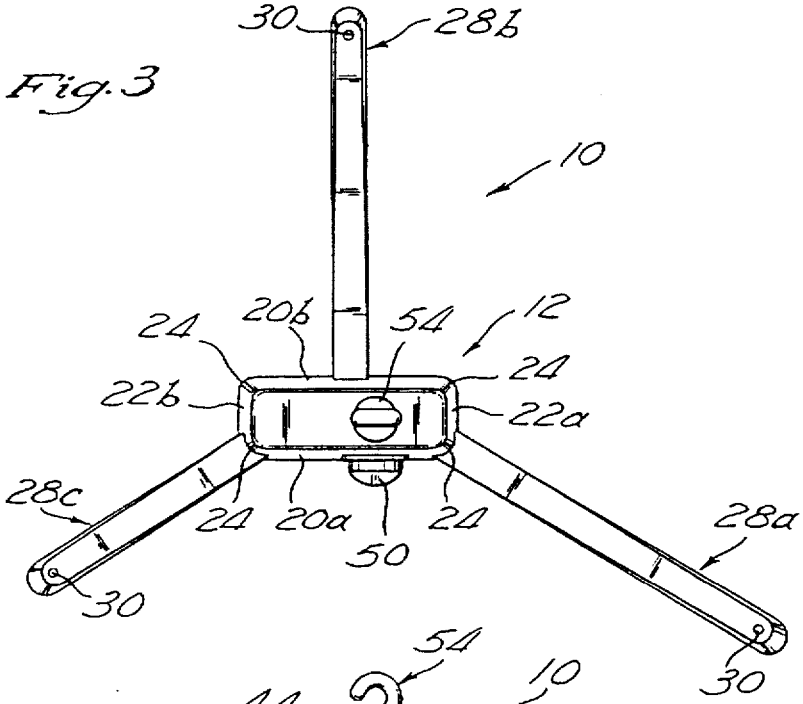
FIG. 3 is a top plan view of the present invention.

In the preferred embodiment, the housing 12 and arms 28*a*, 28*b*, 28*c* are each fabricated from a plastic material. Additionally, the arms 28*a*, 28*b*, 28*c* are integrally connected to the upper housing section 14 (i.e., are formed as integral portions of the upper housing section 14). In this respect, the upper housing section 14 (including the arms 28*a*, 28*b*, 28*c*) and the lower housing section 16 are each preferably fabricated via an injection molding process. As seen in FIG. 1, formed within the distal end of each of the arms 28*a*, 28*b*, 28*c* is an aperture 30 which is used to facilitate the attachment of a decorative ornament 32 (shown in phantom) thereto. Additionally, as seen in FIG. 2, the upper housing section 14 is preferably molded in a manner wherein the arms 28*a*, 28*b*, 28*c* are not solid elements, but rather have generally hollow configurations.

Figure 5:
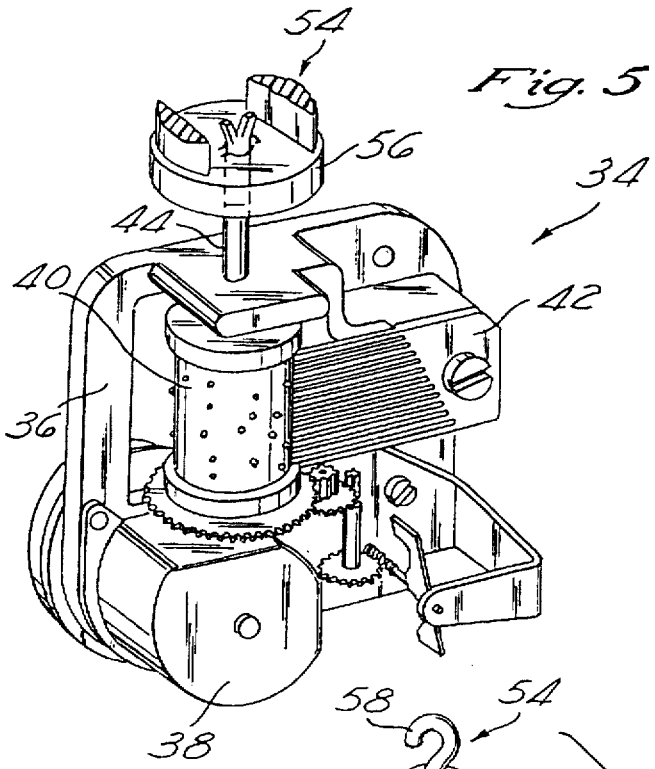
FIG. 5 is a perspective view of the musical drive unit disposed within the housing of the three arm mobile shown in FIGS. 1–4.

Referring now to FIGS. 1, 5 and 6, the upper and lower housing sections 14, 16, when attached to each other, collectively define a hollow interior compartment within the housing 12. Disposed within this interior compartment is a wind-up musical drive unit 34 which is perspectively illustrated in FIG. 5. The drive unit 34 comprises a base member 36 having a motor 38 attached thereto. Extending from the motor 38 is an input shaft (not shown) which, when the drive unit 34 is disposed within the housing 12, extends toward the opening defined by the recesses 26.

Mechanically coupled to the motor 38 is a rotatable drum 40 including a plurality of projections on the outer surface thereof which, when the drum 40 is rotated, selectively pluck the splines of a music producing element 42 attached to the base member 36. As seen in FIGS. 5 and 6, extending axially from the drum 40 is an output shaft 44 which is sized and configured to protrude from an aperture 46 disposed within the top surface 48 of the upper housing section 14 when the drive unit 34 is disposed within the housing 12. Due to the configuration of the drive unit 34, the aperture 46, like the opening defined by the recesses 26, is not centrally positioned within the top surface 48 between the lateral sides 22*a*, 22*b*, but rather is offset toward the lateral side 22*a*. The manual winding of the motor 38 facilitates the rotation of the drum 40 and the output shaft 44 at different speeds. In the drive unit 34, the base member 36 is attached to the output shaft 44 so as to be rotatable thereby.

The winding of the motor 38 of the drive unit 34 is facilitated by a circularly configured plastic handle member 50 rotatably connected to the housing 12, and in particular to the longitudinal side 20*a* thereof. The handle member 50 is disposed within the opening collectively defined by the recesses 26, and is mechanically coupled to the input shaft of the motor 38. The handle member 50 is prevented from being pulled off of the input shaft and out of the opening within the housing 12 by the engagement of a continuous flange 52 extending about the periphery thereof against the inner surface of the housing 12 circumventing the opening defined by the recesses 26. The winding of the motor 38 is facilitated by the clockwise rotation of the handle member 50. As will be recognized, the operation of the motor 38 causes the counter-clockwise rotation of the handle member 50.

As best seen in FIGS. 1, 5 and 6, rotatably connected to the output shaft 44, and in particular to the portion thereof protruding from the aperture 46 within the upper housing section 14, is a suspension hook 54 which is preferably fabricated from a plastic material. The suspension hook 54 includes a circularly configured base portion 56 having an aperture extending axially therethrough which is sized and configured to slidably receive the output shaft 44. In addition to the base portion 56, the suspension hook 54 includes a hook portion 58 which is adapted to be attachable to a base unit secured to the crib. Importantly, when the hook portion 58 is attached to the base unit secured to the crib, the subsequent winding of the motor 38 causes the output shaft 44 to rotate within and relative to the suspension hook 54 which remains stationary. The concurrent rotation of the output shaft 44 and base member 36 of the drive unit 34 facilitates the rotation of the housing 12 due to the drive unit 34 being disposed within the interior thereof. Since the drum 40 and output shaft 44 rotate at different speeds, the music producing element 42 is caused to play musical notes by the rotation of the drum 40, despite the music producing element 42 being attached to the simultaneously rotating base member 36 of the drive unit 34.

The mobile 10 constructed in accordance with the preferred embodiment of the present invention is suspended over the crib mattress simply by securing the suspension hook 54, and in particular the hook portion 58 thereof, to the distal end of the support base attached to the crib. Thereafter, the rotation of the handle member 50 in a clockwise direction facilitates the winding of the motor 38, which in turn causes the rotation of the housing 12 and arms 28*a*, 28*b*, 28*c*, in addition to the playing of musical tune which emanates from the drive unit 34 within the housing 12. Due to the inclusion of the drive unit 34 within the housing 12 and extension of only three arms 28*a*, 28*b*, 28*c* therefrom, the mobile 10 of the present invention is significantly less costly to produce than those constructed in accordance with the prior art. Additionally, the inclusion of the musical drive unit 34 within the housing 12 allows the mobile 10 to be maintained at a greater elevation relative to the crib mattress when suspended from the support base.

Since the motor 38 and drum 40 of the drive unit 34 are oriented toward one side of the base member 36, the housing 12 is not centrally weighted when the drive unit 34 is disposed therein. To compensate for this non-uniform weight distribution and balance the housing 12 to maintain the same in a substantially level orientation when the ornaments 32 are suspended therefrom, the arms 28*a*, 28*b*, 28*c* are formed to have the previously described first and second lengths. These differing lengths, in addition to balancing the housing 12, also provide the mobile 10 with an aesthetically pleasing, proportional overall appearance.

Additional modifications and improvements of the present invention may also be apparent to those skilled in the art. Thus, the particular combination of parts described and illustrated herein is intended to serve as only one embodiment of the present invention, and is not intended to serve as limitations of alternative devices within the spirit and scope of the invention.

What is claimed is:

1. A decorative mobile, comprising:

a central housing defining opposed pairs of longitudinal and lateral sides separated by four corner regions;

a generally rectangular wind-up musical drive unit disposed within the housing and having an output shaft extending therefrom which protruded from the housing and rotates when the drive unit is operatively wound, said housing being configured to accept the drive unit; and three elongate arms including two arms of a first substantially equal length and one arm of a second length which is less than the first length, one of the arms of the first length being attached to and extending from one of the longitudinal sides, with tho other arm of the first length and the arm of the second length being attached to and extending from respective ones of the corner regions;

the first and second lengths of the arms being selected to balance the housing by compensating for the non-uniform weight distribution created by the drive unit therewithin, and to provide the mobile with a proportional appearance.

2. The mobile of claim 1 wherein the arms are separated by intervals of approximately 120°.

3. The mobile of claim 1 wherein each of the arms is arcuately contoured.

4. The mobile of claim 1 wherein each of the arms includes an aperture disposed therein for facilitating the attachment of a decorative ornament thereto.

5. The mobile of claim 1 wherein the housing and the arms are each fabricated from a plastic material.

6. The mobile of claim 1 wherein the housing and the arms are integrally connected to each other.

7. The mobile of claim 1 further comprising a handle member rotatably connected to the housing and mechanically coupled to the drive unit for selectively winding the drive unit.

8. The mobile of claim 1 further comprising a suspension hook rotatably connected to the output shaft.

9. The mobile of claim 1 wherein said housing comprises upper and lower housing sections attached to each other, said arms being attached to and extending from said upper housing section.

10. The mobile of claim 1 wherein the first length exceeds the second length by approximately 2.0 inches.

11. The mobile of claim 1 wherein each of the arms includes a decorative ornament suspended therefrom in a non-removable manner, said ornaments being of approximately similar weight.

* * * * *